US007164339B2

(12) United States Patent
Huang

(10) Patent No.: US 7,164,339 B2
(45) Date of Patent: Jan. 16, 2007

(54) INTEGRATED TRANSFORMER WITH STACK STRUCTURE

(75) Inventor: Kai-Yi Huang, Hsinchu (TW)

(73) Assignee: Winbond Electronics Corp., Hsinchu (TW)

( * ) Notice: Subject to any disclaimer, the term of this patent is extended or adjusted under 35 U.S.C. 154(b) by 57 days.

(21) Appl. No.: 10/906,540

(22) Filed: Feb. 24, 2005

(65) Prior Publication Data

US 2006/0077028 A1 Apr. 13, 2006

(30) Foreign Application Priority Data

Oct. 8, 2004 (TW) ..... 93130516 A

(51) Int. Cl.
*H01F 5/00* (2006.01)

(52) U.S. Cl. ..... 336/200; 336/223; 336/232

(58) Field of Classification Search ..... 336/200, 336/223, 232

See application file for complete search history.

(56) References Cited

U.S. PATENT DOCUMENTS 3,904,911 A 9/1975 Welsch ..... 313/366
4,816,784 A * 3/1989 Rabjohn ..... 333/24 R
6,707,367 B1 * 3/2004 Castaneda et al. ..... 336/200
6,867,677 B1 * 3/2005 Nielson ..... 336/200
6,940,386 B1 * 9/2005 Mukherjee et al. ..... 336/200
6,967,555 B1 * 11/2005 Yu et al. ..... 336/200

* cited by examiner

*Primary Examiner*—Anh Mai
(74) *Attorney, Agent, or Firm*—Jiang Chyun IP Office

(57) ABSTRACT

An integrated transformer with a stack structure comprises a middle dielectric layer, a bottom dielectric layer, a first winding and a second winding. A portion of the first winding is disposed over a surface of the middle dielectric layer and the remaining portion of the first winding is disposed over a surface of the bottom dielectric layer. A portion of the second winding is disposed over the surface of the middle dielectric layer and the remaining portion of the second winding is disposed over the surface of the bottom dielectric layer. The second winding doesn't intersect with the first winding. The portions of the first and second windings over the surface of the middle dielectric layer connect with the remaining portions of the first and second windings over the surface of the bottom dielectric through via plugs.

19 Claims, 11 Drawing Sheets

INTEGRATED TRANSFORMER WITH STACK STRUCTURE

CROSS-REFERENCE TO RELATED APPLICATION

This application claims the priority benefit of Taiwan application Ser. No. 93130516, filed Oct. 8, 2004.

BACKGROUND OF THE INVENTION

1. Field of the Invention

The present invention relates to an integrated transformer, and more particularly to an integrated transformer with a stack structure.

2. Description of the Related Art

For integrated circuits applied in wireless communication, transformers convert impedance among different signals. In order to effectively reduce circuit interference resulting from common-mode noises, more and more circuits adopt the design of differential signal pairs. Accordingly, transformers must transform single-ended unbalance signals into differential balance signals. One of these transformers is the balance-to-unbalance (BALUN) transformer.

FIG. 1 is a schematic drawing showing an equivalent circuit of a BALUN transformer. Referring to FIG. 1, the BALUN transformer 100 comprises a primary side P and a secondary side S. Wherein, the first terminal 11 of the primary side P of the BALUN transformer 100 receives/outputs unbalance signals, and the second terminal 13 is grounded. In addition, the secondary side S comprises a first terminal 15, a second terminal 17, and a center tap 19. Wherein, the center tap 19 is coupled to a reference voltage which is generally grounded. The first terminal 15 and the second terminal 17 of the secondary side S outputs/receives inversed balance signals, respectively.

FIG. 2 is a configuration showing a conventional BALUN transformer. Referring to FIG. 2, conductive lines 21 and 23 wind like a spiral in the BALUN transformer 200. Wherein, two terminals of the conductive line 21 are two terminals of the primary side P, receiving/outputting unbalance signals, respectively. Two terminals of the conductive line 23 are two terminals of the secondary side S, outputting/receiving balance signals, respectively. The disadvantage of the BALUN transformer 200 is that the location of the center tap 25 can only be determined after electrical performance of winding is measured.

In order to solve the issue in FIG. 2, U.S. Pat. No. 3,904,911 discloses several BALUN transformers. In these BALUN transformers disclosed in U.S. Pat. No. 3,904,911, the winding conductive line is only one circle and is not practical.

FIG. 3A is a configuration showing another conventional BALUN transformer. Referring to FIG. 3A, the integrated circuit comprises symmetric windings and the location of the center tap CT can be easily determined. This structure, however, has an asymmetric pattern between the winding of the primary side P and the winding of the secondary side S.

FIG. 3B is a configuration showing another conventional BALUN transformer. Referring to FIG. 3B, it is a BALUN transformer disclosed in U.K. Patent No. 8,800,115. Though the BALUN transformer disclosed in FIG. 3B can resolve the issue in FIG. 3A, the area required for the transformer is relatively larger. As a result, the area of the integrated circuit also increases.

FIG. 4A is a top view of a conventional BALUN transformer. FIG. 4B is a cross sectional view of the BALUN transformer of FIG. 4A along 4K–4K'. In order to solve the issue for the large area required in FIG. 3B, a BALUN transformer with a stack structure is disclosed as shown in FIGS. 4A and 4B.

It is known from FIGS. 4A and 4B, the conventional BALUN transformer with the stack structure comprises a top winding 41 and the bottom winding 43, which wind over the first surface and the second surface of the dielectric layer 45, respectively. Wherein, two terminals of the top winding 41 are two terminals of the primary side P of the BALUN transformer 400. Similarly, the two terminals of the bottom winding 43 are two terminals of the secondary side S of the BALUN transformer 400. With the stack structure, the area required for the BALUN transformer 400 can be reduced.

The BALUN transformer 400 still has some disadvantages. In FIG. 4A, due to the asymmetric pattern between the top winding 41 and the bottom winding 43, the location of the center tap is hard to determine. In addition, the distance from the top winding 41 to the substrate 47 is different from the distance from the bottom winding 43 to the substrate 47. As a result, the parasitic capacitance on the primary side and the secondary sides are different. Therefore, electrical characteristics of the BALUN transformer 400 are hard to control.

SUMMARY OF THE INVENTION

Accordingly, the present invention is directed to an integrated transformer with a stack structure. With symmetric structure of the windings, locations of center taps can be easily determined.

The present invention is also directed to an integrated transformer with a stack structure, wherein the primary side and the secondary side have the same turn ratio and the same parasitic capacitance.

The present invention is directed to an integrated transformer with a stack structure, capable of effectively reducing insertion loss and enhancing coupling capabilities.

The present invention provides an integrated transformer with a stack structure. A top portion of the first winding is disposed over the surface of the middle dielectric layer, comprising a first conductive line of a primary side and a second conductive line of the primary side. Both conductive lines are laid as a first preset pattern and symmetric to each other through a first axis. Wherein, a terminal of the first conductive line of the primary side is a first terminal of the primary side of the integrated transformer, and another terminal of the first conductive line of the primary side is a first plug terminal of the primary side. Similarly, a terminal of the second conductive line of the primary side is a second terminal of the primary side of the integrated transformer, and another terminal of the second conductive line of the primary side is a second plug terminal of the primary side. In addition, a bottom portion of the first winding is disposed over the surface of the bottom dielectric layer, comprising a third conductive line of a primary side and a fourth conductive line of the primary side. Both conductive lines are laid as a second preset pattern and symmetric to each other through a second axis. Wherein, a terminal of the third conductive line of the primary side is a third plug terminal of the primary side, and another terminal of the third conductive line connects with the fourth conductive line of the primary side at the second axis. Another terminal of the fourth conductive line of the primary side is the fourth plug terminal of the primary side. The present invention also comprises a first via plug and a second via plug connecting the first plug terminal of the primary side and the third plug terminal of the primary side, and the second plug terminal of the primary side and the fourth plug terminal of the primary side, respectively. In addition, a top portion of the second winding is disposed over the surface of the middle dielectric layer, comprising a first conductive line of a secondary side and a second conductive line of the secondary side. Both conductive lines are symmetric to each other through a first axis and symmetric to the first conductive line of the primary side and the second conductive line of the primary side through the third axis, respectively. Wherein, a terminal of the first conductive line of the secondary side is a first terminal of the secondary side of the integrated transformer in the present invention, and another terminal of the first conductive line of the secondary side is a first plug terminal of the secondary side. A terminal of the second conductive line of the secondary side is a second terminal of the secondary side of the integrated transformer in the present invention, and another terminal of the second conductive line of the secondary side is a second plug terminal of the secondary side. A bottom portion of the second winding is disposed over the surface of the bottom dielectric layer, comprising a third conductive line of a secondary side and a fourth conductive line of the secondary side. Both conductive lines are symmetric to each other through the second axis and symmetric to the third conductive line of the primary side and the fourth conductive line of the primary side through the fourth axis, respectively. Wherein, a terminal of the third conductive line of the secondary side is a third plug terminal of the secondary side, and another terminal of the third conductive line connects with the fourth conductive line of the secondary side at the second axis. Another terminal of the fourth conductive line of the secondary side is the fourth plug terminal of the secondary side. The present invention also comprises a third via plug and a fourth via plug, connecting the first plug terminal of the secondary side and the third plug terminal of the secondary side, and the second plug terminal of the secondary side and the fourth plug terminal of the secondary side, respectively.

In another aspect, the present invention also provides an integrated transformer with a stack structure, comprising dielectric layers, a first winding and a second winding. Wherein, a portion of the first winding is disposed over a surface of the middle dielectric layer, the remaining portion of the first winding is disposed over a surface of the bottom dielectric layer, and two terminals of the first winding are two terminals of the primary side of the integrated transformer in the present invention. Similarly, a portion of the second winding is disposed over the surface of the middle dielectric layer, and the remaining portion of the second winding is disposed over the surface of the bottom dielectric layer. Two terminals of the second winding are two terminals of the secondary side of the integrated transformer in the present invention. In order to establish a symmetric pattern between these windings, the first winding crosses over the second winding on the surface of the middle dielectric layer, and the same applies on the surface of the bottom dielectric layer. In addition, these two windings lie in parallel, but do not intersect.

Accordingly, the first conductive line of the primary side is symmetric to the second conductive line of the primary side through the first axis, and the third conductive line of the primary side is symmetric to the fourth conductive line of the primary side through the second axis. In addition, first conductive line of the secondary side and the second conductive line of the secondary side are symmetric to the first conductive line of the primary side and the second conductive line of the primary side through the third axis, respectively. The third conductive line of the secondary side and the fourth conductive line of the secondary side are symmetric to the third conductive line of the primary side and the fourth conductive line of the primary side through the fourth axis, respectively. Due to the symmetric pattern of the primary side and the secondary side, the locations of center taps can be easily determined.

Because portions of both first winding and the second winding are disposed over the surface of the bottom dielectric layer and the surface of the middle dielectric layer, the primary side and the secondary side of the present invention have the same parasitic capacitance. Electrical characteristics can thus be well controlled. Moreover, these windings have horizontal and vertical electromagnetic coupling, so insertion loss can be reduced and coupling capabilities are enhanced.

The winding structure according to the present invention is a two-layer structure. Each layer may be a signal conductive line or multi-layer conductive lines connected in parallel so that the conductive lines may cross over each other. Accordingly, the top dielectric portion and the middle dielectric portion may comprise a single metal coil or multiple metal coils, and the dielectric layers.

The above and other features of the present invention will be better understood from the following detailed description of the embodiments of the invention that is provided in communication with the accompanying drawings.

DESCRIPTION OF SOME EMBODIMENTS

First Embodiment

Figure 1:
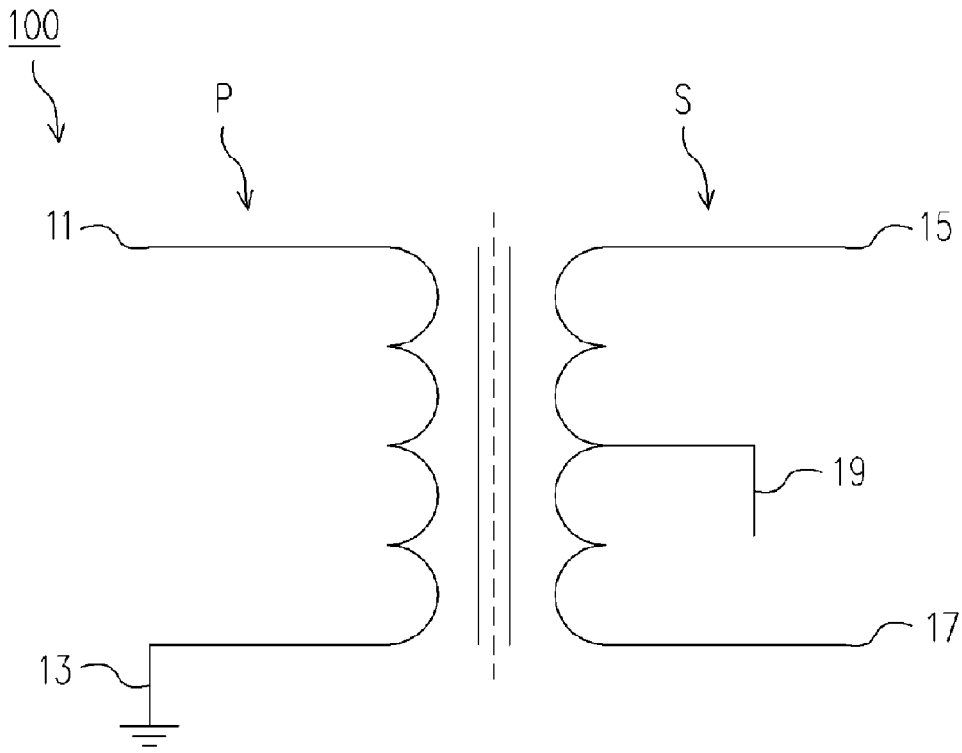
FIG. 1 (PRIOR ART)
FIG. 1 is a schematic drawing showing an equivalent circuit of a BALUN transformer.
Figure 2:
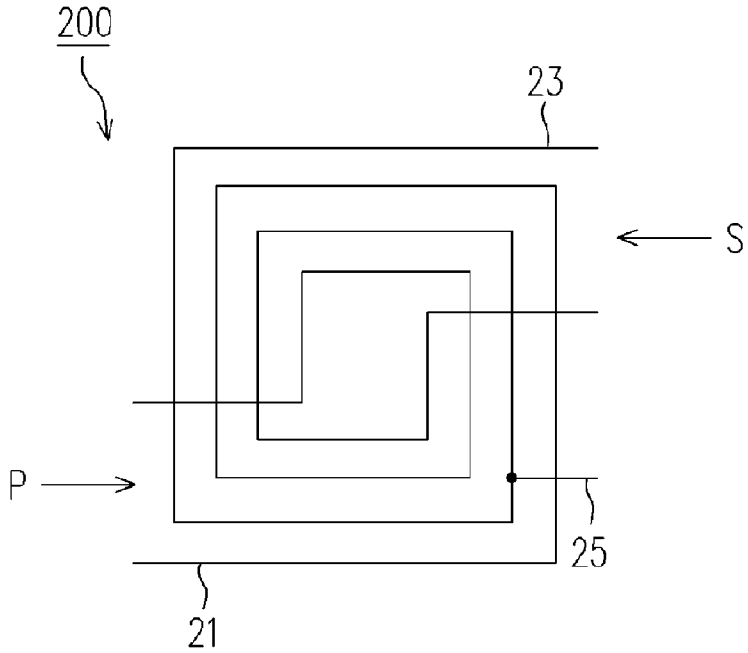
FIG. 2 (PRIOR ART)
FIG. 2 is a configuration showing a conventional BALUN transformer.
Figure 3A:
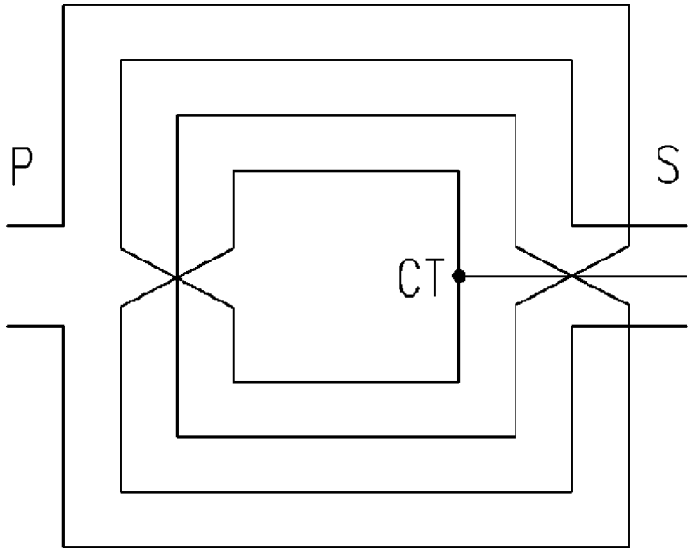
FIG. 3A (PRIOR ART)
FIG. 3A is a configuration showing another conventional BALUN transformer.
Figure 3B:
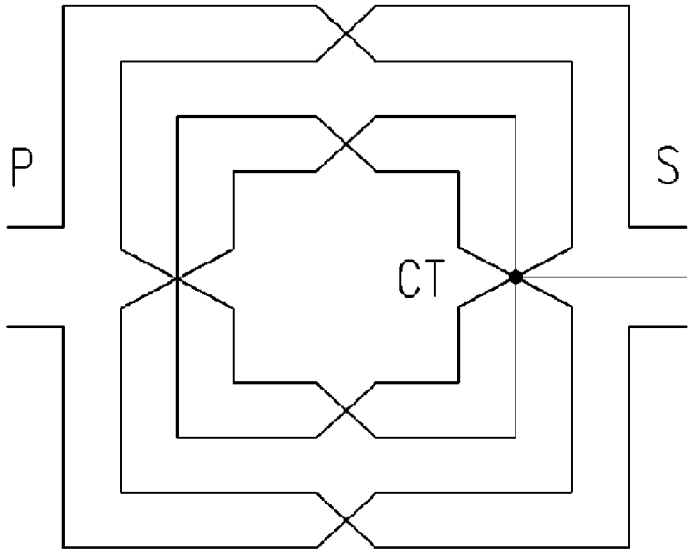
FIG. 3B (PRIOR ART)
FIG. 3B is a configuration showing another conventional BALUN transformer.
Figure 4A:
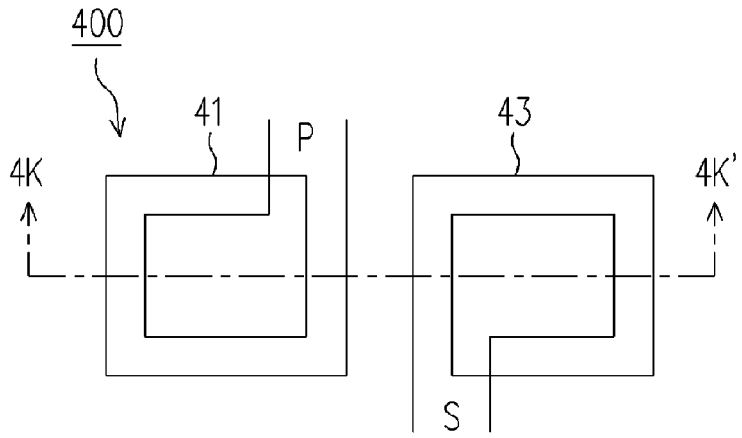
FIG. 4A (PRIOR ART)
FIG. 4A is a top view of a conventional BALUN transformer.
Figure 4B:
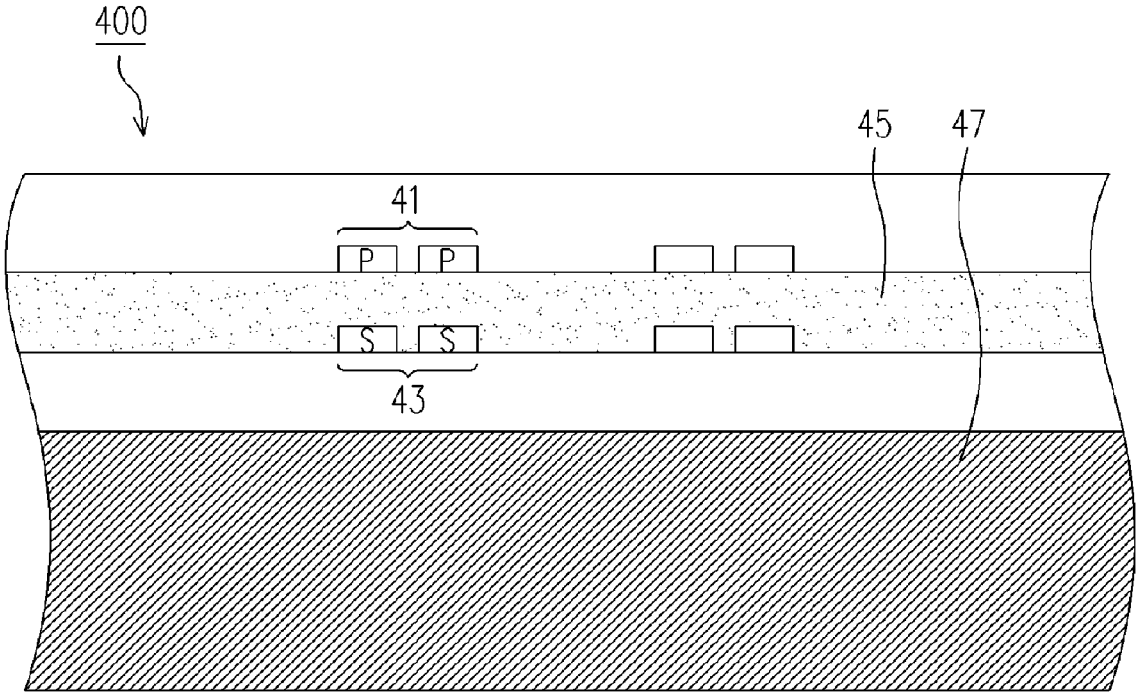
FIG. 4B (PRIOR ART)
FIG. 4B is a cross-sectional view of the BALUN transformer of FIG. 4A along 4K–4K'.
Figure 5A:
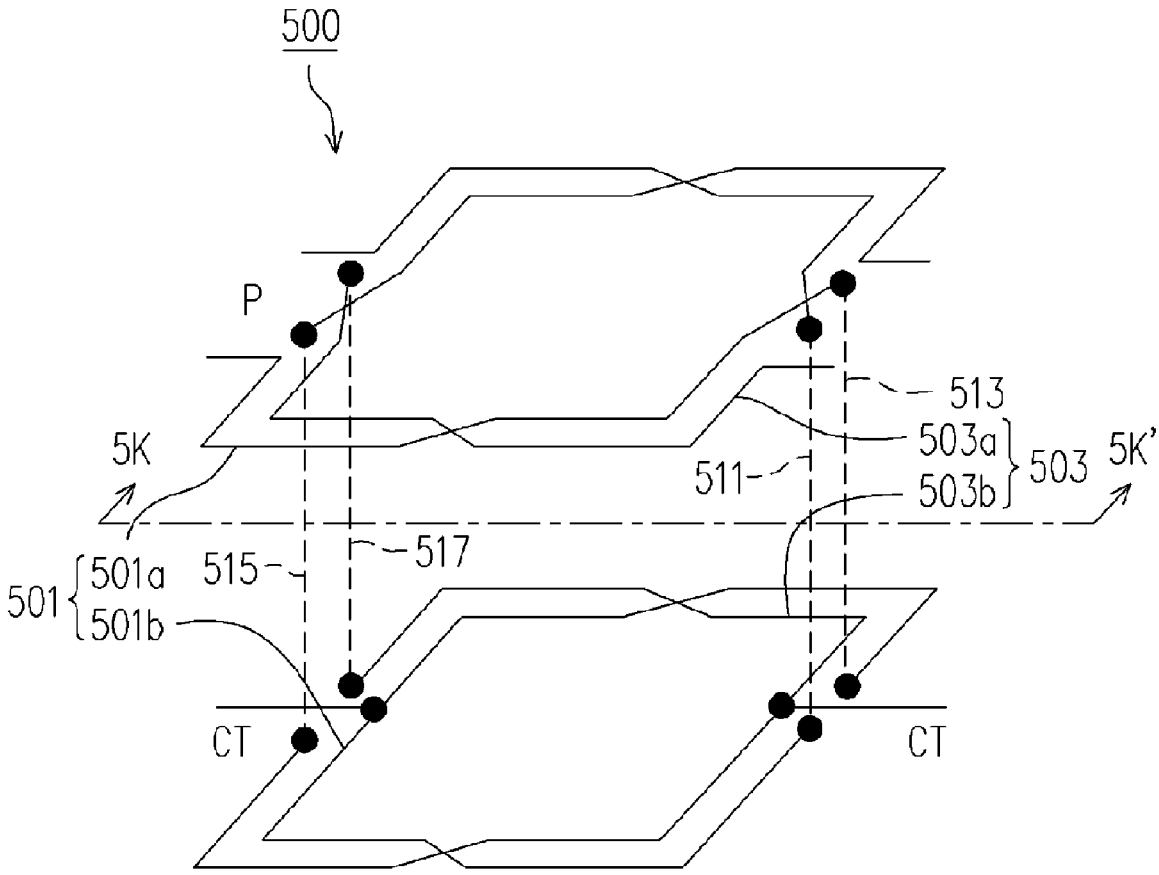
FIG. 5A is a schematic drawing showing a 3-D integrated transformer with a stack structure according to the first embodiment of the present invention.
Figure 5B:
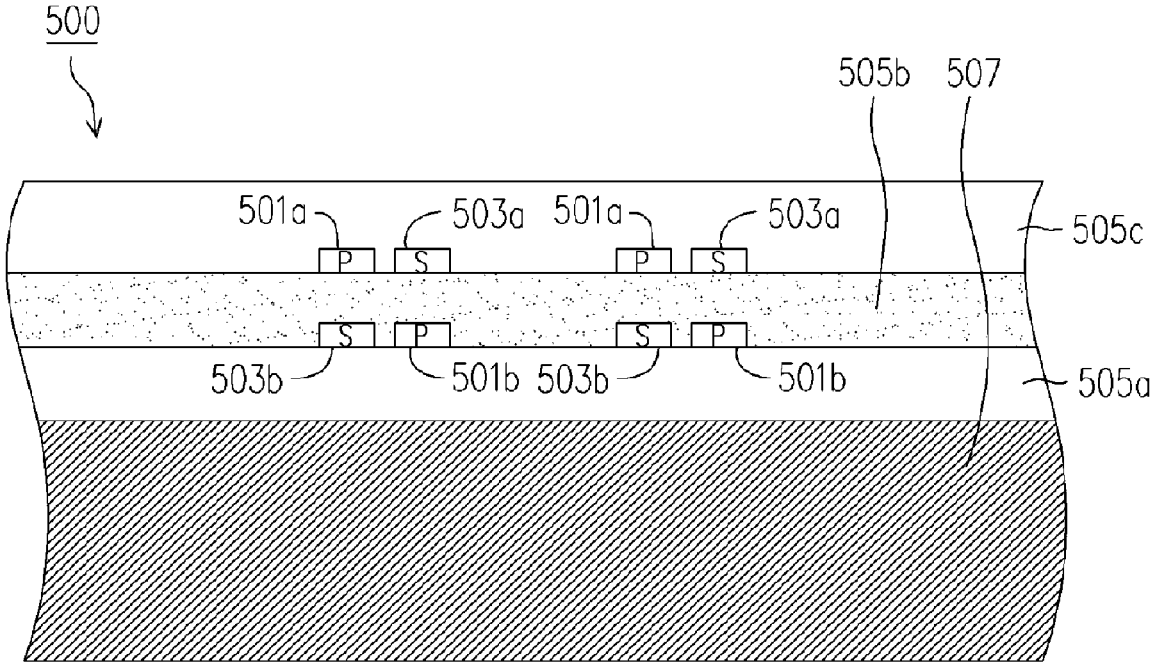
FIG. 5B is a cross-sectional view of the integrated transformer with a stack structure along 5K–5K' in FIG. 5A.

FIG. 5A is a schematic drawing showing a 3-D integrated transformer with a stack structure according to the first embodiment of the present invention. FIG. 5B is a cross sectional view of the integrated transformer with a stack structure along 5K–5K' in FIG. 5A. Referring to FIGS. 5A and 5B, the integrated transformer 500 comprises a first winding 501 and a second winding 503. Wherein, portions of the first winding 501 and the second winding 503, 501*a* and 503*a*, respectively, are disposed over the surface of the middle dielectric layer 505*b*. The other portions 501*b* and 503*b* are over the surface of the bottom dielectric layer 505*a*. In addition, in order to form a symmetric pattern within and between these windings, the top portion 501*a* of the first winding 501 crosses over the top portion 503*b* of the second winding 503, and the same applies to the bottom portion 501*b* of the first winding 501 and the bottom portion 503*b* of the winding 503. These two windings lie reversed in parallel, but do not intersect.

In this embodiment, the structure of these two windings of the present invention is a two-layer structure. One of ordinary skill in the art should understand that each layer may comprise a single conductive line or multiple conductive lines connected in parallel so that they can cross over each other. Accordingly, the structure in the top dielectric layer 505*c* and the middle dielectric layer 505*b* may be a combination of a single metal coil or a multi-layer metal coil, and the dielectric layer.

Referring to FIG. 5A, the top portion 501*a* of the first winding 501 connects with the bottom portion 501*b* of the first winding 501 through via plugs 511 and 513. Similarly, the top portion 503*a* of the second winding 503 connects with the bottom portion 503*b* of the second winding 503 through via plugs 515 and 517.

According to FIG. 5B, portions of the first winding 501 and the second winding 503 are disposed over the surfaces of the middle dielectric layer 505*b* and the bottom dielectric layer 505*a*, respectively. Accordingly, the parasitic capacitance between the first winding 501 and the substrate 507, and the parasitic capacitance between the second winding 503 and the substrate 507 are substantially equal. Because these windings have horizontal and vertical electromagnetic coupling, the insertion loss can be reduced and the coupling capabilities are thus enhanced.

Figure 5C:
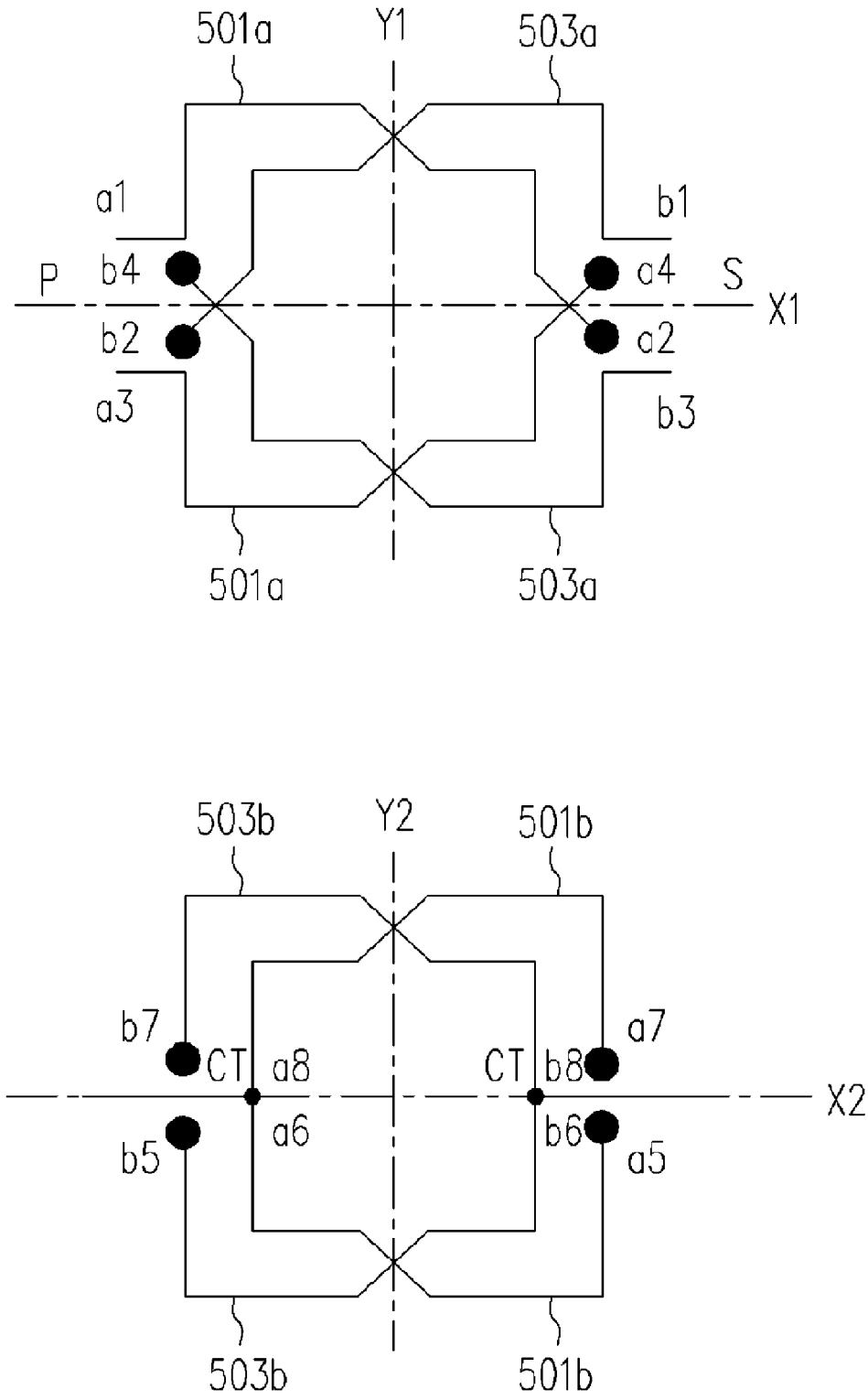
FIG. 5C is a top view of the integrated transformer of FIG. 5A.

FIG. 5C is a top view of the integrated transformer of FIG. 5A. Referring to FIGS. 5A to 5C, the top portion 501*a* of the first winding 501, i.e., the top portion of the primary side, is disposed over the surface of the middle dielectric layer 505*b*, comprising a first conductive line a1–a2 of the primary side and a second conductive line a3–a4 of the primary side. They are laid as the first preset pattern and symmetric to each other through the axis X1. Wherein, the a1 terminal of the first conductive line of the primary side is the first terminal of the primary side P of the integrated transformer 500. The a2 terminal of the first conductive line of the primary side P is the first plug terminal of the primary side P. The a3 terminal of the second conductive line of the primary side P is the second terminal of the primary side P of the integrated transformer 500. The a4 terminal of the first conductive line of the primary side is the second plug terminal of the primary side P.

The top portion 501*b* of the first winding 501 is disposed over the surface of the bottom dielectric layer 505*a*, comprising a third conductive line a5–a6 of the primary side P and a fourth conductive line a7–a8 of the primary side P. The third conductive line a5–a6 of the primary side P and the fourth conductive line a7–a8 of the primary side P are laid as the second preset pattern and symmetric to each other through the axis X2. Wherein, the a6 terminal of the third conductive line of the primary side P and the a8 terminal of the fourth conductive line of the primary side P are connected at the axis X2, where the center tap CT of the integrated transformer 500 is disposed. In addition, the a5 terminal of the third conductive line of the primary side P is the third plug terminal of the primary side, and connects with the first plug terminal of the primary side P, i.e., the a2 terminal of the first conductive line of the primary side P, through the via plug 513. The terminal a7 of the fourth conductive line of the primary side P is the fourth plug terminal of the primary side P, and connects with the second plug terminal of the primary side P, i.e., the terminal a4 of the second conductive line of the primary side P, through the via plug 511.

In the second winding 503, the top portion 503*a* of the second winding 503, i.e., the top portion of the secondary side S, is disposed over the surface of the middle dielectric layer 505*b*, comprising a first conductive line b1–b2 of the secondary side S and a second conductive line b3–b4 of the secondary side S. They are laid as the first preset pattern. That is, the first conductive line of the secondary side S is symmetric to the second conductive line of the secondary side S through the axis X1. Moreover, the first conductive line of the secondary side S and the second conductive line of the secondary side S are symmetric to first conductive line of the primary side P and the second conductive line of the primary side P through the axis Y1, respectively. In addition, the b1 terminal of the first conductive line of the secondary side S is the first terminal of the secondary side S of the integrated transformer 500. The b2 terminal of the first conductive line of the secondary side S is the first plug terminal of the secondary side S. The b3 terminal of the second conductive line of the secondary side S is the second terminal of the secondary side S of the integrated transformer 500. The b4 terminal of the first conductive line of the secondary side is the second plug terminal of the secondary side S.

The top portion 503*b* of the second winding 503, i.e. the bottom portion of the secondary side S, is disposed over the surface of the bottom dielectric layer 505*a*, comprising a third conductive line b5–b6 of the secondary side S and a fourth conductive line b7–b8 of the secondary side S. Similarly, the third conductive line of the secondary side S is symmetric to the fourth conductive line of the secondary side S through the axis X2. Moreover, the third conductive line of the secondary side S and the fourth conductive line of the secondary side S are symmetric to the third conductive line of the primary side P and the fourth conductive line of the primary side P through the axis Y2, respectively. Wherein, the b6 terminal of the third conductive line of the secondary side S and the b8 terminal of the fourth conductive line of the secondary side S is connected at the axis X2, where the center tap CT of the integrated transformer 500 is disposed. In addition, the b5 terminal of the third conductive line of the secondary side S is the third plug terminal of the secondary side S, and connects with the first plug terminal of the secondary side S, i.e. the b2 terminal of the first conductive line of the secondary side S, through the via plug 515. The b7 terminal of the fourth conductive line of the secondary side S is the fourth plug terminal of the secondary side S, and connects with the second plug terminal of the secondary side S, i.e. the b4 terminal of the second conductive line of the secondary side S, through the via plug 517.

In this embodiment, these axes X1 and Y1, and these axes X2 and Y2 may vertical to each other, respectively. In addition, the axis X2 can be a vertical projection of the axis X1 on the bottom of the dielectric layer 505*b*. Additionally, the axis Y2 can be a vertical projection of the axis Y1 on the bottom of the dielectric layer 505.

The integrated transformer of the present invention can serve as a BALUN transformer. That is, the first terminal or the second terminal of the primary side P of the integrated transformer 500 may be grounded, and the center tap CT where the third conductive line of the secondary side S and the fourth conductive line of the secondary side S are connected, can be coupled to the reference voltage. Accordingly, the integrated transformer 500 can receive unbalance signals at the primary side P and output inversed balance signals at two terminals of the secondary side S. Based on the same theory, the integrated transformer 500 may also transfer balance signals into unbalance signals. Detailed descriptions are not repeated.

According to the structure of the present embodiment, the number of coils over the surface of the middle dielectric layer and the surface of the bottom dielectric layer on the primary side P can be of odd number, such as 1, 3, 5, . . . etc. Accordingly, the total number of coils over the surface of the middle dielectric layer and the surface of the bottom dielectric layer on the primary side P is an even number, such as 2, 6, 10, . . . etc. The structure of the second side S is similar, and detailed descriptions are not repeated.

To provide more conductive coils combination to meet different requirement, the present invention provides several embodiments. One of ordinary skill in the art, after viewing the present invention, should understand how to modify the winding method and the number of coils. All these modifications fall within the scope of the present invention.

Second Embodiment

Figure 6:
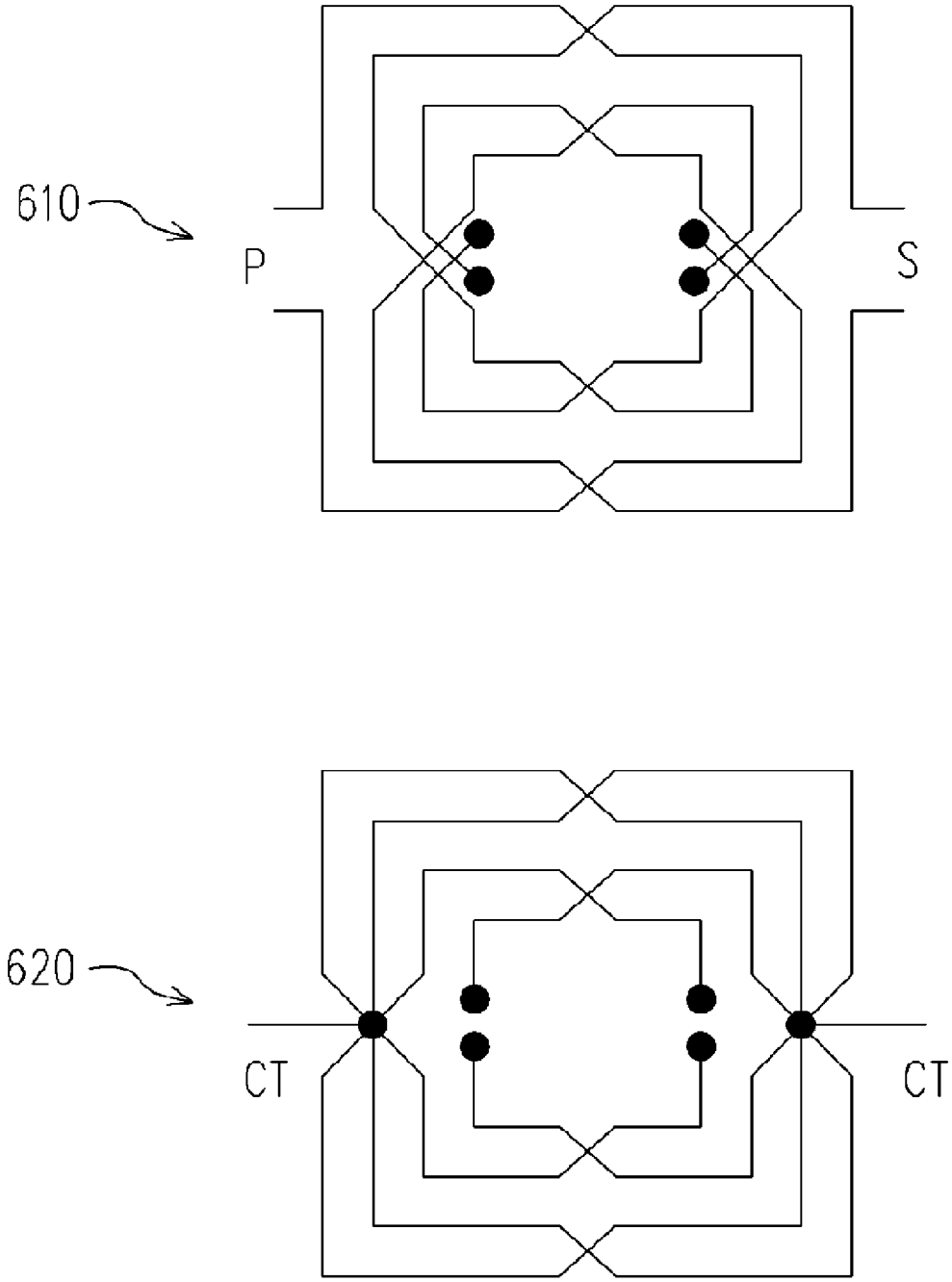
FIG. 6 is a top view of an integrated transformer with a stack structure according to the second embodiment of the present invention.

FIG. 6 is a top view of an integrated transformer with a stack structure according to the second embodiment of the present invention. Referring to FIG. 6, the portion 610 is equivalent to the surface portion of the middle dielectric layer 505*b* in FIG. 5B. The portion 620 is equivalent to the surface of the bottom dielectric layer 505*a*. The structure of the integrated transformer in the present embodiment can refer to the first embodiment and detailed descriptions are not repeated.

In FIG. 6, the numbers of coils on portions of 610 and 620 of the primary side P can be of even numbers, such as 2, 4, 6, . . . etc. Accordingly, the total number of the coils on the primary side P is 4, 8, 12, . . . etc. Similarly, the secondary side S has the same structure and detailed descriptions are not repeated.

Third Embodiment

Figure 7:
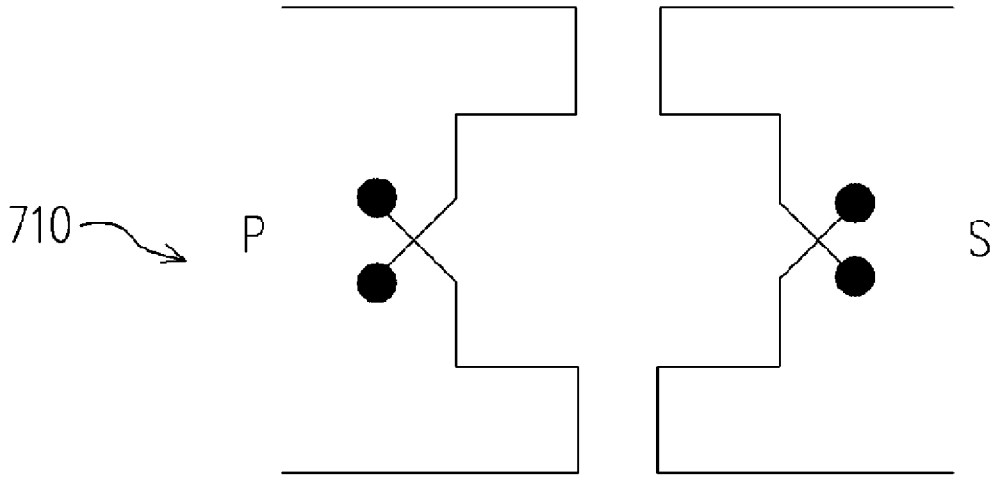
FIG. 7 is a top view of an integrated transformer with a stack structure according to the third embodiment of the present invention.
Figure 7:
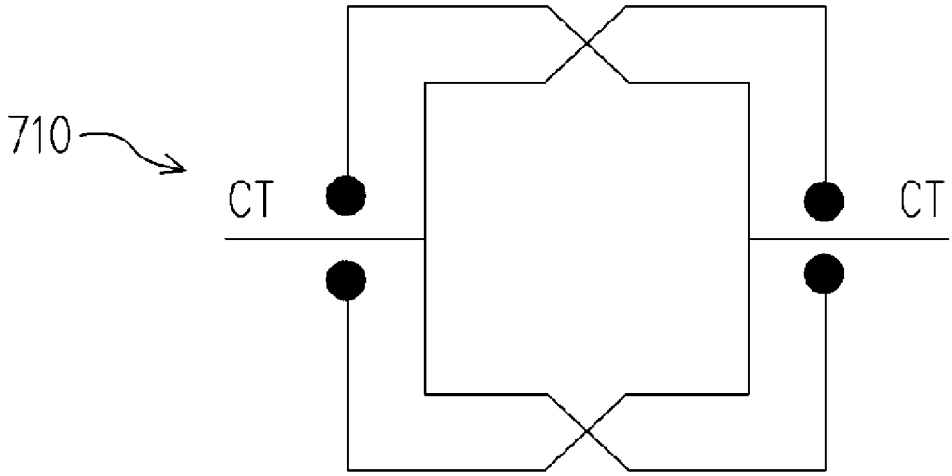

FIG. 7 is a top view of an integrated transformer with a stack structure according to the third embodiment of the present invention. Referring to FIG. 7, the portion 710 is equivalent to the surface portion of the middle dielectric layer 505*b* in FIG. 5B. The portion 720 is equivalent to the surface of the bottom dielectric layer 505*a*. The structure of the integrated transformer can refer to the first embodiment and detailed descriptions are not repeated.

In FIG. 7, the numbers of coils on portions of 710 and 720 of the primary side P can be multiples by 1.5, such as 1.5, 3, 4.5, . . . etc. Accordingly, the total number of the coils on the primary side P is 3, 6, 9, . . . etc. Similarly, the secondary side has the same structure and detailed descriptions are not repeated.

Fourth Embodiment

Figure 8:
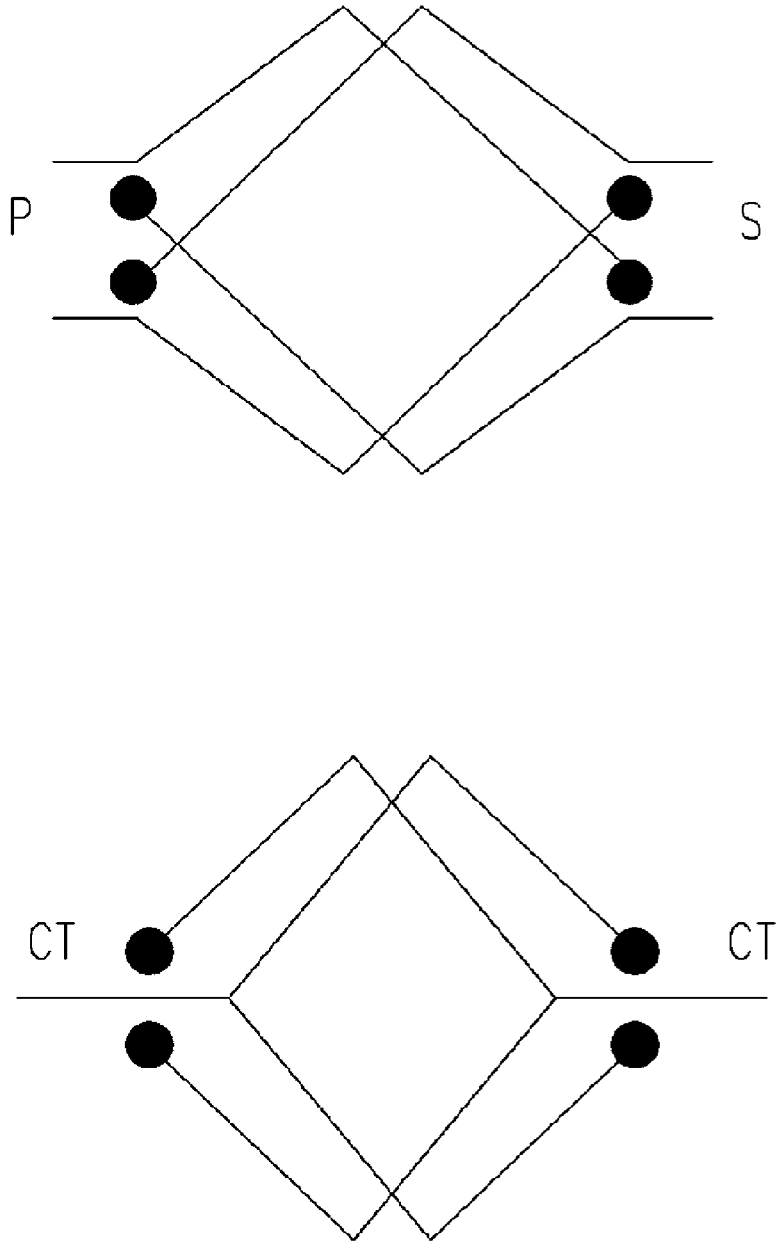
FIG. 8 is a top view of an integrated transformer with a stack structure according to the fourth embodiment of the present invention.

FIG. 8 is a top view of an integrated transformer with a stack structure according to the fourth embodiment of the present invention. Referring to FIG. 8, this embodiment discloses an integrated transformer with a diamond shape structure. The real structure of this embodiment can refer to the first embodiment. In this embodiment, similar to the first embodiment, the total number of coils on the primary side P or the secondary side S is 4, 8, 12, . . . etc, and detailed descriptions are not repeated.

Fifth Embodiment

Figure 9:
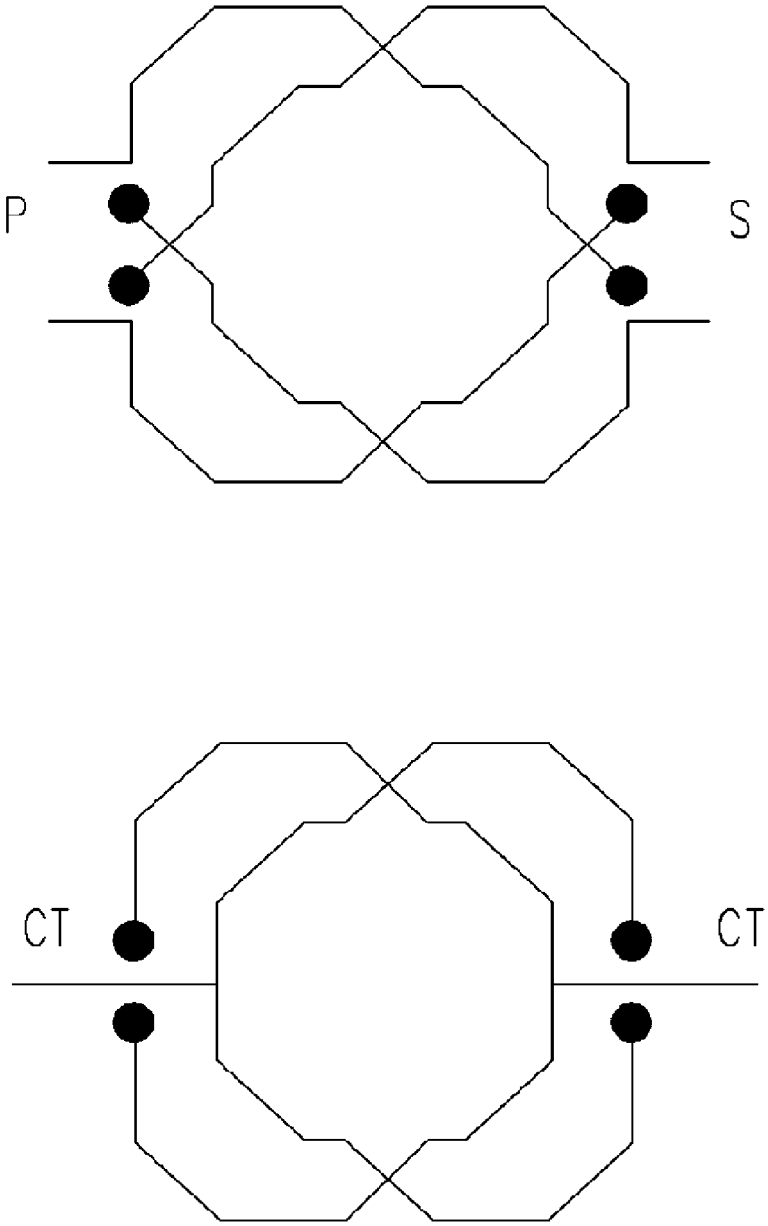
FIG. 9 is a top view of an integrated transformer with a stack structure according to the fifth embodiment of the present invention.

FIG. 9 is a top view of an integrated transformer with a stack structure according to the fifth embodiment of the present invention. Referring to FIG. 9, this embodiment discloses an integrated transformer with an octagonal shape structure. The real structure of this embodiment can refer to the first embodiment. In this embodiment, similar to the first or fourth embodiment, the total number of coils on the primary side P or the secondary side S is 4, 8, 12, . . . etc, and detailed descriptions are not repeated.

Sixth Embodiment

Figure 10:
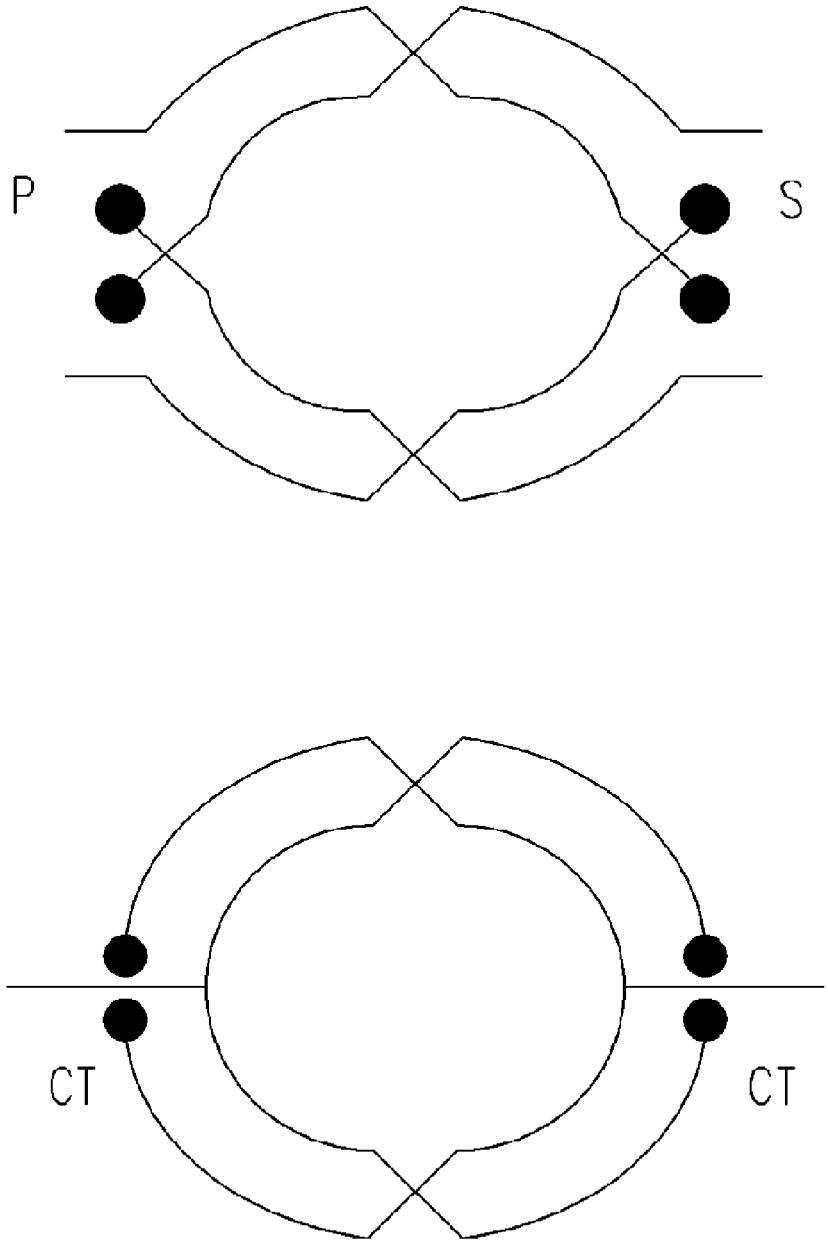
FIG. 10 is a top view of an integrated transformer with a stack structure according to the sixth embodiment of the present invention.

FIG. 10 is a top view of an integrated transformer with a stack structure according to the sixth embodiment of the present invention. Referring to FIG. 10, this embodiment discloses an integrated transformer with a circle shape structure. The real structure of this embodiment can refer to the first embodiment. In this embodiment, similar to the previous embodiments, the total number of coils on the primary side P or the secondary side S is 4, 8, 12, . . . etc and detailed descriptions are not repeated.

Accordingly, the present invention has at least the following merits:

1. The present invention provides an integrated transformer with a stack structure, which occupies a smaller area.

2. In the present invention, the first conductive line of the primary side and the third conductive line of the primary side are symmetric to the second conductive line of the primary side and the fourth conductive line of the primary side through axes X1 and X2, respectively. In addition, the first conductive line of the secondary side and the third conductive line of the secondary side are also symmetric to the second conductive line of the secondary side and the fourth conductive line of the secondary side through axes X1 and X2, respectively. Moreover, the first conductive line of the secondary side and the third conductive line of the secondary side are symmetric to the first conductive line of the primary side and the third conductive line of the primary side through the axis Y1, respectively. The second conductive line of the secondary side and the fourth conductive line of the secondary side are symmetric to the second conductive line of the primary side and the fourth conductive line of the primary side through axis Y2, respectively. Accordingly, the locations of the center taps can be easily determined.

3. Portions of the first winding and the second winding are disposed over the surface of the middle dielectric layer, and the remaining portions of the first winding and the second winding are disposed over the surface of the bottom dielectric layer. Therefore, the parasitic capacitance on the primary side and the secondary side are substantial equivalent. The devices of the present invention have better characteristics.

4. According to the real requirements, the present invention may include different numbers of conductive coils on the primary side and the secondary side.

5. In the present invention, these windings have horizontal and vertical electromagnetic coupling. Therefore, the insertion loss can be reduced and the coupling capabilities can also be enhanced.

Although the present invention has been described in terms of exemplary embodiments, it is not limited thereto. Rather, the appended claims should be constructed broadly to include other variants and embodiments of the invention which may be made by those skilled in the field of this art without departing from the scope and range of equivalents of the invention.

What is claimed is:

1. An integrated transformer with a stack structure, comprising:

a middle dielectric layer;

a bottom dielectric layer;

a first conductive line of a primary side disposed over a surface of the middle dielectric layer, laid as a first preset pattern, wherein a terminal of the first conductive line of the primary side is a first terminal of the primary side of the integrated transformer, and another terminal of the first conductive line of the primary side is a first plug terminal of the primary side;

a second conductive line of the primary side disposed over the surface of the middle dielectric layer, laid as the first preset pattern, wherein the second conductive line of the primary side is symmetric to the first conductive line of the primary side through a first axis, a terminal of the second conductive line of the primary side is a second terminal of the primary side of the integrated transformer, and another terminal of the second conductive line of the primary side is a second plug terminal of the primary side;

a third conductive line of the primary side disposed over a surface of the bottom dielectric layer, laid as a second preset pattern, wherein a terminal of the third conductive line of the primary side is a third plug terminal of the primary side;

a first via plug, connecting the first plug terminal of the primary side and the third plug terminal of the primary side;

a fourth conductive line of the primary side disposed over the surface of the bottom dielectric layer, laid as the second preset pattern, wherein the fourth conductive line of the primary side is symmetric to the third conductive line of the primary side through a second axis, a terminal of the fourth conductive line of the primary side and another terminal of the third conductive line of the primary side, which is in a opposite position to the third plug terminal of the primary side, are connected at the second axis, and another terminal of the fourth conductive line of the primary side is a fourth plug terminal of the primary side;

a second via plug, connecting the second plug terminal of the primary side and the fourth plug terminal of the primary side;

a first conductive line of a secondary side disposed over the surface of the middle dielectric layer, symmetric to first conductive line of the primary side through a third axis, wherein a terminal of the first conductive line of the secondary side is a first terminal of the secondary side of the integrated transformer, and another terminal of the first conductive line of the secondary side is a first plug terminal of the secondary side;

a second conductive line of the secondary side disposed over the surface of the middle dielectric layer, symmetric to the second conductive line of the primary side through the third axis and symmetric to the first conductive line of the secondary side through the first axis, wherein a terminal of the second conductive line of the secondary side is a second terminal of the secondary side of the integrated transformer, and another terminal of the second conductive line of the secondary side is a second plug terminal of the secondary side;

a third conductive line of the secondary side disposed over the surface of the bottom dielectric layer, symmetric to the third conductive line of the primary side through a fourth axis, wherein a terminal of the third conductive line of the secondary side is a third plug terminal of the secondary side;

a third via plug, connecting the first plug terminal of the secondary side and the third plug terminal of the secondary side;

a fourth conductive line of the secondary side disposed over the surface of the bottom dielectric layer, symmetric to the fourth conductive line of the primary side through the fourth axis and symmetric to the third conductive line of the secondary side through the second axis, wherein a terminal of the fourth conductive line of the secondary side and another terminal of the third conductive line of the secondary side, which opposite to the third plug terminal of the secondary side, are connected at the second axis, and another terminal of the fourth conductive line of the secondary side is a fourth plug terminal of the secondary side; and a fourth via plug, connecting the second plug terminal of the secondary side and the fourth plug terminal of the secondary side.

2. The integrated transformer with a stack structure of claim 1, wherein the first conductive line of the primary side, the second conductive line of the primary side, the third conductive line of the primary side and the fourth conductive line of the primary side do not intersect with the first conductive line of the secondary side, the second conductive line of the secondary side, the third conductive line of the secondary side and the fourth conductive line of the secondary side.

3. The integrated transformer with a stack structure of claim 1, wherein the first axis is orthogonal to the third axis.

4. The integrated transformer with a stack structure of claim 1, wherein the second axis is orthogonal to the fourth axis.

5. The integrated transformer with a stack structure of claim 1, wherein the second axis is a vertical projection of the first axis on the surface of the bottom dielectric layer.

6. The integrated transformer with a stack structure of claim 1, wherein the fourth axis is a vertical projection of the third axis on the surface of the bottom dielectric layer.

7. The integrated transformer with a stack structure of claim 1, wherein a location at which the third conductive line of the primary side and the fourth conductive line of the primary side are connected is a center tap of the integrated transformer.

8. The integrated transformer with a stack structure of claim 1, wherein a location at which the third conductive line of the secondary side and the fourth conductive line of the secondary side are connected is a center tap of the integrated transformer.

9. An integrated transformer with a stack structure, comprising:

a middle dielectric layer;

a bottom dielectric layer;

a first winding, wherein a portion of the first winding is disposed over a surface of the middle dielectric layer, the remaining portion of the first winding is disposed over a surface of the bottom dielectric layer, and two terminals of the first winding are two terminals of the primary side of the integrated transformer; and a second winding, wherein a portion of the second winding is disposed over the surface of the middle dielectric layer, the remaining portion of the first winding winds is disposed over the surface of the bottom dielectric layer, the second winding does not intersect with the first winding, and two terminals of the second winding are two terminals of the secondary side of the integrated transformer.

10. The integrated transformer with a stack structure of claim 9, wherein the portion of the first winding over the surface of the middle dielectric layer connects with the remaining portion of the first winding disposed over the surface of the bottom dielectric layer through a via plug.

11. The integrated transformer with a stack structure of claim 9, wherein the portion of the second winding over the surface of the middle dielectric layer is connected with the remaining portion of the second winding disposed over the surface of the bottom dielectric layer through a via plug.

12. The integrated transformer with a stack structure of claim 9, wherein a pattern formed by a portion of the first winding over the surface of the middle dielectric layer is symmetric through a first axis.

13. The integrated transformer with a stack structure of claim 9, wherein a pattern formed by a portion of the second winding over the surface of the middle dielectric layer is symmetric through a first axis.

14. The integrated transformer with a stack structure of claim 9, wherein a pattern formed by the remaining portion of the first winding over the surface of the bottom dielectric layer is symmetric through a second axis.

15. The integrated transformer with a stack structure of claim 14, wherein a location at which the remaining portion of the first winding over the surface of the bottom dielectric layer connects with the second axis is a center tap of the integrated transformer.

16. The integrated transformer with a stack structure of claim 9, wherein a pattern formed by the remaining portion of the second winding over the surface of the bottom dielectric layer is symmetric through a second axis.

17. The integrated transformer with a stack structure of claim 16, wherein a location at which the remaining portion of the second winding over the surface of the bottom dielectric layer connects with the second axis is a center tap of the integrated transformer.

18. The integrated transformer with a stack structure of claim 9, wherein a pattern formed by a portion of the first winding over the surface of the middle dielectric layer is symmetric to a pattern formed by a portion of the second winding over the surface of the middle dielectric layer through a third axis.

19. The integrated transformer with a stack structure of claim 9, wherein a pattern formed by the remaining portion of the first winding over the surface of the bottom dielectric layer is symmetric to a pattern formed by the remaining portion of the second winding over the surface of the bottom dielectric layer through a fourth axis.

* * * * *